US008245681B2

(12) United States Patent
Wanner et al.

(10) Patent No.: US 8,245,681 B2
(45) Date of Patent: Aug. 21, 2012

(54) STARTER FOR AN INTERNAL COMBUSTION ENGINE HAVING AN ELECTRICALLY INSULATING INSULATING PART, INTERNAL COMBUSTION ENGINE HAVING A STARTER, RETAINING FLANGE

(75) Inventors: Hartmut Wanner, Herrenberg-Oberjesingen (DE); Wilhelm Post, Sachsenheim (DE); Uwe Daurer, Kornwestheim (DE); Jochen Kuch, Bretten (DE); Heinrich Otto Kuch, legal representative, Bretten (DE); Christa Elsa Kuch, legal representative, Bretten (DE); Oliver Neumann, Heilbronn (DE); Gerhard Kraemer, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 335 days.

(21) Appl. No.: 12/310,005

(22) PCT Filed: Jul. 9, 2007

(86) PCT No.: PCT/EP2007/056988

§ 371 (c)(1),
(2), (4) Date: Nov. 12, 2009

(87) PCT Pub. No.: WO2008/019913

PCT Pub. Date: Feb. 21, 2008

(65) Prior Publication Data

US 2010/0089354 A1 Apr. 15, 2010

(30) Foreign Application Priority Data

Aug. 16, 2006 (DE) ..... 10 2006 038 350

(51) Int. Cl.
*F02N 15/00* (2006.01)

(52) U.S. Cl. ..... 123/179.25; 123/195 A

(58) Field of Classification Search ..... 123/179.25, 123/195 R, 195 A, 195 C
See application file for complete search history.

(56) References Cited

U.S. PATENT DOCUMENTS

| | | | | |
|---|---|---|---|---|
| 5,163,335 | A * | 11/1992 | Isom et al. | 74/6 |
| 5,847,471 | A | 12/1998 | Morishita et al. | |
| 5,927,240 | A * | 7/1999 | Maxon | 123/179.3 |
| 6,026,695 | A | 2/2000 | Bartlett et al. | |
| 7,075,202 | B2 * | 7/2006 | Leoni | 310/83 |
| 2004/0000822 | A1 | 1/2004 | Leoni | |

FOREIGN PATENT DOCUMENTS

| | | |
|---|---|---|
| DE | 196 20 848 | 11/1996 |
| DE | 197 00 376 | 1/1998 |
| DE | 10 2008 002 102 A1 * | 12/2009 |
| FR | 1 446 485 | 6/1965 |

* cited by examiner

*Primary Examiner* — Hai Huynh
(74) *Attorney, Agent, or Firm* — Kenyon & Kenyon LLP

(57) ABSTRACT

A starter for an internal combustion engine, particularly for an internal combustion engine of a motor vehicle, having a housing, on which a mounting flange is developed that can be associated with the internal combustion engine, at least one insulating part being associated with the mounting flange, such that no electrical connection exists between the starter and the internal combustion engine. An internal combustion engine, particularly for a motor vehicle, has a starter as described above. A retaining flange for an electric motor, particularly for a starter of a motor vehicle, the retaining flange being developed as an insulating part, and is made up at least partially of an electrically insulating material and/or has at least one electrically insulating insulating element situated on the retaining flange.

14 Claims, 3 Drawing Sheets

STARTER FOR AN INTERNAL COMBUSTION ENGINE HAVING AN ELECTRICALLY INSULATING INSULATING PART, INTERNAL COMBUSTION ENGINE HAVING A STARTER, RETAINING FLANGE

FIELD OF THE INVENTION

The present invention relates to a starter for an internal combustion engine, particularly for an internal combustion engine of a motor vehicle, having a housing on which a mounting flange is developed that is associable with the internal combustion engine.

BACKGROUND INFORMATION

Starters are known from the related art which have a retaining flange that is developed as one piece with the starter, or rather with a part of the starter, especially with the so-called A-bearing. The retaining flange is formed and dimensioned, in this context, as a function of the size of the starter and/or as a function of individual customer preferences.

One embodiment of the mounting flange in steel or aluminum always yields an electrical connection of the starter to the internal combustion engine, in this context. However, in some applications, an insulated design of the starter is desired, so as to keep the vehicle electrical system of a motor vehicle separate from the internal combustion engine. For this purpose, the starter may be designed in such a way, for example, that the current-conducting parts of the starter are electrically separated from the housing. In the course of time, this internal insulation is reduced by the abrasion of the carbon brushes during operation, since the abraded material settles as a carbon dust film inside the housing, thus being able to create a galvanic connection to the starter housing, and, with that, to the internal combustion engine.

SUMMARY OF THE INVENTION

At least one electrically insulating insulating part is associated with the mounting flange, according to the present invention, so that there is no electrical connection between the starter and the internal combustion engine, or rather, a starter housing and an internal combustion engine housing. Because of this, one may do without costly internal insulation of the starter, and assure a lasting electrical insulation between the starter and the internal combustion engine.

The insulating part is expediently at least partially made of an electrically insulating material, in order to separate the starter electrically from the internal combustion engine. The starter is preferably connected to the internal combustion engine only via the insulating part. This means that there is no direct contact between the internal combustion engine and the starter, and thus there is implemented a secure electrical decoupling of the internal combustion engine from the starter, so that the internal combustion engine has no electrical contact to the vehicle electrical system of the motor vehicle via the starter.

According to one refinement of the present invention, the insulating part has at least one region made up of the electrically insulating material, and is developed over the entire cross section or a partial range of the cross section. Thus, in the insulating part, in the direction of the connection, an electrically conductive region follows an electrically insulating region, for example. Because of the development of the insulating region over the entire cross section of the insulating part, it is possible to achieve complete electrical decoupling of the two units connected by the insulating part.

The partial range, which is made up of the electrically insulating material, expediently extends from out of the end face of the insulating part that is associated with the internal combustion engine and/or the starter, so that an electrically conducting region of the insulating part does not come directly in contact with the internal combustion engine and/or the starter.

At least one electrically insulating insulating element is advantageously situated on the insulating part, the insulating element being fastened, for instance, by adhesion to one of the end faces of the insulating part. This yields an even more favorable, more easily manufactured possibility of preventing electrical contact between starter and internal combustion engine. Accordingly, the insulating part may, for instance, be made basically of an electrically conductive material, and maintain its insulating effect solely because of insulating elements situated on it. For this purpose, the insulating element is advantageously developed as an insulating platelet or an insulating ring. A plurality of insulating platelets are positioned at least one end face, advantageously distributed over the circumference of the insulating part. Of course, care also has to be taken with the insulation of fastening elements, such as screws, electrically nonconductive fastening elements advantageously being used and/or the contact areas of the insulating part and/or of the mounting flange, that are in contact with the fastening elements, being made of the insulating material, or have appropriately formed, associated insulating elements. The insulating ring may be provided, for this purpose, as a washer for nuts or screw heads that are used for fastening the insulating part.

In the area of a screw opening and/or on the inside of the openings, the insulating part is preferably made of the insulating material, so that a partial insulation may be produced without having to do without the mechanical fastening values of the material originally used for the mounting flange. For this purpose, alternatively, an appropriately formed sleeve made of an insulating material is situated in the opening.

The entire insulating part is advantageously made of the insulating material, so that it is able to be produced as simply and cost-effectively as possible, and a secure insulation is assured between the starter and the internal combustion engine.

The insulating part is preferably developed as a retaining flange able to be associated with the internal combustion engine. Thus, the starter is able to be fastened on the internal combustion engine via the insulating part or the retaining flange.

The retaining flange is advantageously developed as a rotary flange that is able to be associated with the starter and/or the internal combustion engine, rotated into at least two positions. This has the advantage that the specific installation position of the starter on an internal combustion engine, and in a space that is available in this context, such as in the engine compartment of a motor vehicle, does not have to be settled in a costly manner in the preliminary stages, and repositioned correspondingly. The retaining flange expediently has an essentially circular ring shape. This offers the simple possibility of implementing the rotation of the starter, about its axial orientation, in a tight space. The retaining flange and/or the mounting flange of the starter is advantageously developed, in this instance, in such a way that the starter rotates stepwise about the rotational axis of the drive shaft, and is able to be fastened in a plurality of determined positions. This makes it easier to develop a fitting mounting flange for an internal combustion engine, since the attachment position of the starter may be adjusted within certain limits to the local circumstances, that is, to the installation space, because of the two-part design approach in the form of the starter having an associated, rotatable, separate retaining flange, or insulating part, which makes possible a degree of freedom with respect to the alignment of the starter with the internal combustion engine. At least one opening or screw opening is advantageously developed in the form of a hole or a slotted hole. A stepwise rotation of the starter and/or the internal combustion engine is made possible by the positioning of a plurality of hole-shaped, that is, circular screw openings or bores in the retaining flange. The stepless rotation of the starter about its axial orientation is implemented in a simple manner using a slotted hole embodiment. The respective screw openings, in this context, naturally correspond to the appropriate lead-through openings and/or screw-thread openings on the mounting flange and/or the housing of the internal combustion engine. The insulating element may also advantageously be developed as an insulating intermediate ring, whose axis is congruent with the circular insulating part that is developed as a retaining flange. The screw openings, in the shape of a hole or a slotted hole, may be electrically insulated, as described above.

A ceramic material, a plastic material and/or an insulating composite material are expediently provided as the insulating material.

The present invention also relates to an internal combustion engine, particularly for a motor vehicle, having a starter as described above. The advantage is that an electrical insulation from the internal combustion engine to the starter is permanently assured by the insulating part.

In addition, the present invention relates to a retaining flange for an electric machine, particularly for a starter of a motor vehicle, the retaining flange being developed as the insulating part, and being partially made of an electrically insulating material, and having at least one electrically insulating insulating element situated on the retaining flange, so that a unit, such as the internal combustion engine, to which the electric machine is to be fastened using the retaining flange, is electrically decoupled from the electric machine.

The retaining flange is advantageously developed as a rotary flange that is able to be situated rotatably into at least two positions.

DETAILED DESCRIPTION

Figure 1:
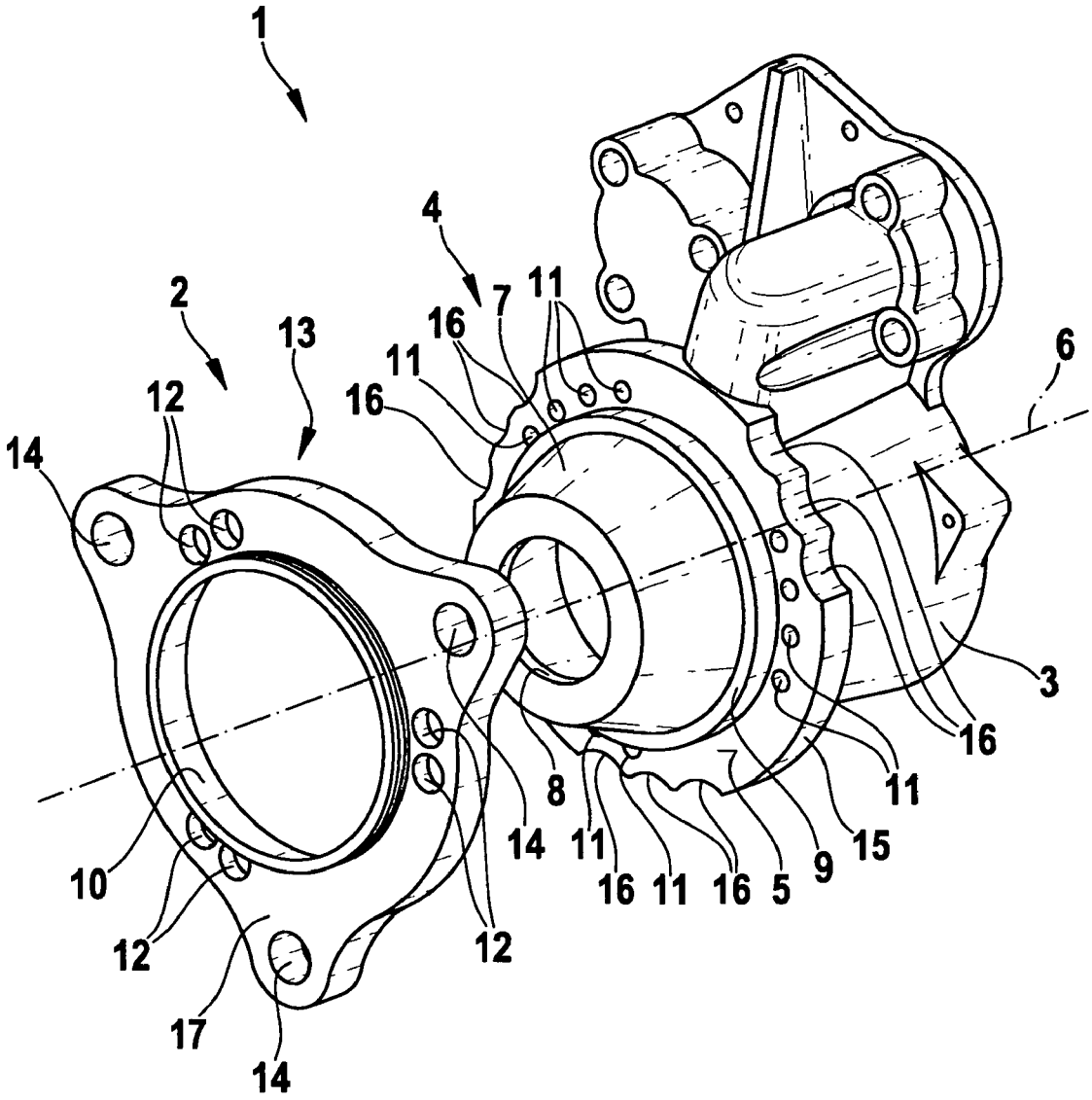
FIG. 1 shows a starter according to the present invention, having a retaining flange, in a perspective exploded representation.

As an exemplary embodiment of the present invention, FIG. 1 shows, in a perspective, exploded representation, a part of a starter 1, according to the present invention, and an insulating part 2 developed as a retaining flange, which is shown at a distance from the starter 1. The part of starter 1 shown is developed as a so-called A-bearing 3, and has a mounting flange 4. Mounting flange 4 has an essentially circular contact surface 5, which is aligned perpendicularly to an axis of rotation 6 of starter 1, axis of rotation 6 characterizing the axis about which a starter shaft, not shown here, rotates having a drive pinion located upon it, which engages with a toothed ring of the internal combustion engine during the starting procedure. On contact surface 5 a conically developed centering projection 7 is situated, which has an opening 8 in its middle, through which the drive pinion of starter 1 is guided. Round about centering projection 7, on contact surface 5, a shoulder is developed, whose diameter approximately corresponds to the internal diameter of annular opening 10 developed in insulating part 2.

In contact surface 5, distributed over the circumference, a plurality of screw openings 11 are situated on a radius about axis of rotation 6, not all repeating elements, such as screw openings 11, being supplied with reference numerals in the figures. Insulating part 2, designed as retaining flange or flange ring, has screw openings 12 on a radius which, in the assembled state, correspond to screw openings 11, insulating part 2 being able to be rotated about axis of rotation 6 in such a way that screw openings 12 developed on insulating part 2 optionally correspond to different screw openings 11 of starter 1, so that insulating part 2 is able to be fastened in different positions on mounting flange 4 of starter 1, or rather of A-bearing 3. For this purpose, screw openings 11 and fastening openings 12 are advantageously aligned axially in parallel to axis of rotation 6. In this context, insulating part 2 is pushed with its circular opening 10 onto shoulder 9, until its rear side 13 lies against contact surface 5.

Insulating part 2, or the retaining flange, has three fastening openings 14 that are offset by 120° with respect to one another, which lie on a radius that is larger than that of screw openings 11 or 12. Retaining flange 4 has recesses 16 at its circumference 15, which are formed and situated in such a way that screws guided through fastening openings 14, which are used, for instance, for fastening insulating part 2 to the internal combustion engine, are able to be guided past mounting flange 4. Recesses 16 are formed in such a way that the screw heads, of the screws guided through, lie in recesses 16. In this context, recesses 16 are also situated in such a way that retaining flange 2 is able to be fastened in a plurality of positions on mounting flange 4.

Under certain circumstances, it may be requested by a customer that there be no electrical contact between starter 1 and an internal combustion engine to which starter 1 is fastened. For this purpose, the starter is frequently constructed in insulated fashion, so that no electric currents or voltages are able to be conducted via its housing. However, over the course of time the internal insulation is decreased because of abrasion of the carbon brushes located in the starter, because carbon dust deposits as a thin film on the components of the starter located in the housing and on the inside of the housing, and thereby produces a galvanic connection.

In order to ensure a durable electrical insulation of the internal combustion engine from starter 1, insulating part 2 is produced at least partially of an electrically insulating material. In this context, insulating part 2 may advantageously have one or more regions made of electrically insulating material that are situated perpendicular to axis of rotation 6, so that no electrical contact is created from starter 1, via insulating part 2 to the internal combustion engine associated with end face 17 of insulating part 2. Alternatively or in addition, the regions around screw openings 12 and/or fastening openings 14 may be produced from electrically insulating material, so that at least a partial insulation is ensured, and the fastening values of the originally used materials continue to be used. A ceramic material, a plastic material and/or an electrically insulating composite material are preferably used as the electrically insulating material.

When the drive pinion of starter 1 engages with a toothed gear of the internal combustion engine, it is true that the electrical insulation is canceled, but in this case, that is no problem for the operation.

Figure 2:
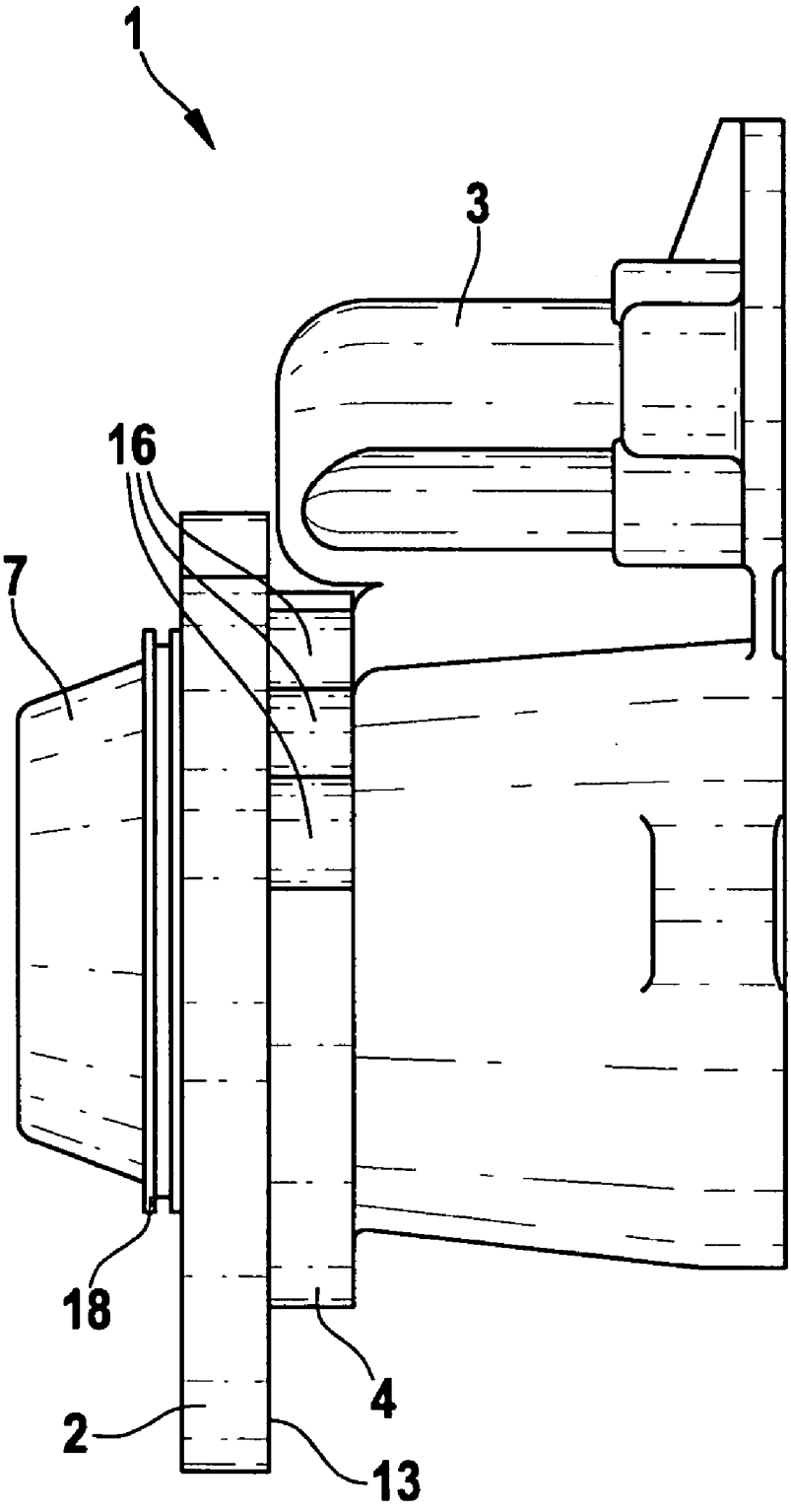
FIG. 2 shows the starter having the retaining flange in a side view.
Figure 3:
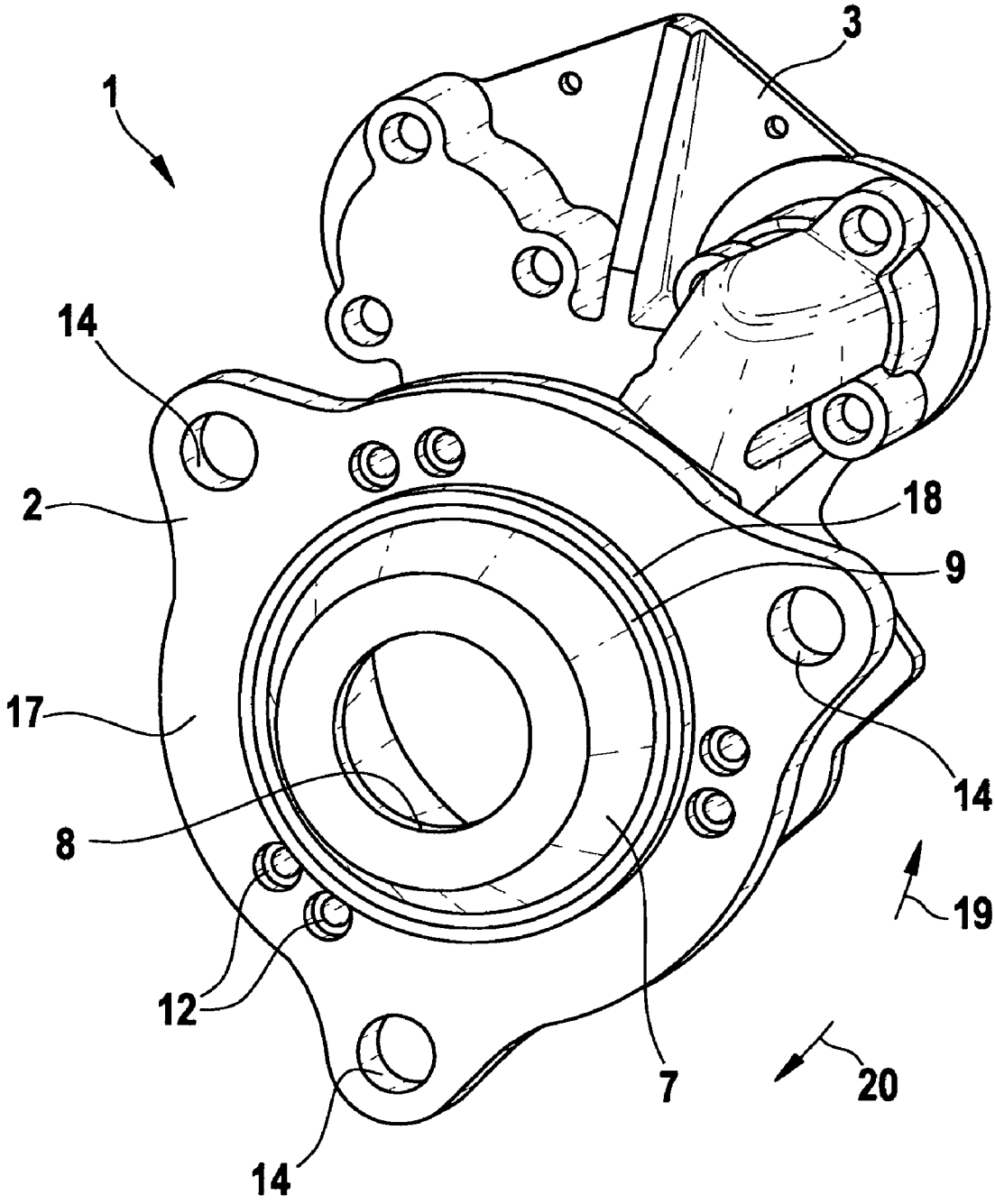
FIG. 3 shows the starter having the retaining flange, in a perspective top view.

FIG. 2 shows starter 1 with insulating part 2 in the assembled state, in a side view. In this representation it may be clearly recognized that insulating part 2 has an axially protruding projection 18 that encloses annular opening 10, and this projection is used for centering, or rather positioning insulating part 2 or starter 1 at the internal combustion engine, during assembly. Centering projection 7 is only used as centering assistance during the mounting of starter 1 at insulating part 2 or at the internal combustion engine, and in the assembled state, it is not in contact with the internal combustion engine or an engine flange developed at a housing of the internal combustion engine. In the assembled state, the starter shaft (not shown here) of starter 1 is also supported in centering projection 7. FIG. 3 shows A-bearing 3 of starter 1 together with insulating part 2 situated on it, in a perspective representation using a view onto end face 17 of insulating part 2. Insulating part 2 can be rotated in the direction of arrows 19 or 20, so that in the assembled position starter 1 is able to be aligned in different positions on the internal combustion engine. In the exemplary embodiment shown here, altogether nine different positions are possible.

In another exemplary embodiment, a subsection extends from end face 17 of insulating part 2 that is associated with the internal combustion engine, and this is made of an electrically insulating material, and extends in such a way that a direct contact of electrically conductive regions of insulating part 2 to the internal combustion engine does not exist, and thus no electrical potential is able to be transmitted.

A ceramic material, a plastic material and/or an insulating composite material is advantageously provided as the insulating material.

What is claimed is:

1. A starter for an internal combustion engine of a motor vehicle, comprising:

a housing on which a mounting flange is situated that is associable with the internal combustion engine; and at least one insulating part associated with the mounting flange, so that no electrical connection exists between the starter and the internal combustion engine.

2. The starter according to claim 1, wherein the insulating part is made at least partially of an electrically insulating material.

3. The starter according to claim 2, wherein the insulating part has at least one region made up of the electrically insulating material, which is situated over an entire cross section or a subsection of the cross section.

4. The starter according to claim 3, wherein the subsection projects from at least one of (a) an end face associated with the internal combustion engine and (b) an end face of the insulating part associated with the starter.

5. The starter according to claim 2, wherein the insulating part is made of the insulating material in a vicinity of at least one screw opening.

6. The starter according to claim 2, wherein the entire insulating part is made of the insulating material.

7. The starter according to claim 2, wherein the insulating material includes at least one of a ceramic material, a plastic material and an insulating composite material.

8. The starter according to claim 1, further comprising at least one electrically insulating element situated on the insulating part.

9. The starter according to claim 8, wherein the insulating element includes one of an insulating platelet and an insulating ring.

10. The starter according to claim 1, wherein the insulating part includes a retaining flange that is associated with the internal combustion engine.

11. The starter according to claim 10, wherein the retaining flange is a rotary flange that is situated on the starter and/or the internal combustion engine, rotated into at least two positions.

12. A retaining flange for an electric machine, comprising:

an insulating part of the retaining flange made at least partially of an electrically insulating material; and at least one electrically insulating element situated on the insulating part.

13. The retaining flange according to claim 12, wherein the retaining flange is for a starter of a motor vehicle.

14. The retaining flange according to claim 12, wherein the retaining flange is a rotary flange that is situated rotated into at least two positions.

* * * * *